United States Patent [19]

Nowak

[11] 3,989,471

[45] Nov. 2, 1976

[54] RADIAL FLOW CATALYTIC CONVERTER HAVING THERMAL EXPANSION COMPENSATING MEANS

[75] Inventor: Hubert H. Nowak, Jackson, Mich.

[73] Assignee: Tenneco Inc., Racine, Wis.

[22] Filed: Apr. 14, 1975

[21] Appl. No.: 567,577

[52] U.S. Cl. ..... 23/288 FC; 60/299

[51] Int. Cl.[2] ..... F01N 3/15; F01N 7/00

[58] Field of Search ..... 23/288 F, 288 FA, 4 FC; 60/299–302, 322; 151/38; 248/358 AA; 55/498, 507, 509–511, DIG. 30; 210/487, 497; 29/157 R, 163.5 F, 455 R; 423/230, 239, 244, 247, 212 C

[56] References Cited

UNITED STATES PATENTS

| | | | |
|---|---|---|---|
| 1,422,211 | 7/1922 | Lamb | 423/247 |
| 2,033,100 | 3/1936 | Kellogg | 151/38 |
| 2,185,584 | 1/1940 | Boyce | 23/288 F |
| 2,683,016 | 7/1954 | Campbell | 248/358 AA |
| 3,041,149 | 6/1962 | Houdry | 23/288 F |
| 3,061,416 | 10/1962 | Kazokas | 23/288 F |
| 3,084,009 | 4/1963 | Heym | 248/358 AA |
| 3,088,271 | 5/1963 | Smith | 23/288 FC |
| 3,094,394 | 6/1963 | Innes et al. | 23/288 F |
| 3,154,388 | 10/1964 | Purse | 23/288 F |
| 3,166,895 | 1/1965 | Slayter et al. | 23/288 FC |
| 3,248,188 | 4/1966 | Chute | 23/288 FC |
| 3,594,131 | 7/1971 | De Palma et al. | 23/288 FC |
| 3,685,972 | 8/1972 | De Palma et al. | 23/288 F |
| 3,692,497 | 9/1972 | Keith et al. | 23/288 F |
| 3,780,772 | 12/1973 | Carnanhan | 23/288 FC |
| 3,801,289 | 4/1974 | Wiley | 23/288 FC |
| 3,809,539 | 5/1974 | Balluff et al. | 23/288 FC |
| 3,817,714 | 6/1974 | Wiley | 23/288 FC |
| 3,841,839 | 10/1974 | Wiley | 23/288 FC |
| 3,841,842 | 10/1974 | Wiley | 23/288 FC |
| 3,843,561 | 10/1974 | Sobel | 23/288 FC |
| 3,852,042 | 12/1974 | Wagner | 23/288 FC |
| 3,854,888 | 12/1974 | Frietzsche et al. | 23/288 FC |
| 3,874,854 | 4/1975 | Hunter | 23/288 FA |

FOREIGN PATENTS OR APPLICATIONS

| | | | |
|---|---|---|---|
| 1,443,886 | 11/1964 | France | 23/288 F |

*Primary Examiner*—Morris O. Wolk
*Assistant Examiner*—Bradley R. Garris
*Attorney, Agent, or Firm*—Harness, Dickey & Pierce

[57] ABSTRACT

A catalytic converter unit of the type used in internal combustion engine exhaust systems has a monolithic refractory catalyst element which is axially retained by means of flat spring pads, such as metal mesh layers or spring washers, and may include a thermal compensation means to help offset different rates of expansion.

2 Claims, 4 Drawing Figures

RADIAL FLOW CATALYTIC CONVERTER HAVING THERMAL EXPANSION COMPENSATING MEANS

BACKGROUND OF THE INVENTION

Catalytic converters for motor vehicle, gasoline-fueled, internal combustion engines must be designed to have a relatively long, trouble-free life and yet be capable of mass production at a low cost. They contain catalyst substrates formed of refractory materials that have a low coefficient of thermal expansion and are relatively brittle. The housing for the catalyst element is composed of metal having a relatively high coefficient of expansion compared to the refractory and the temperature differential between the metal and refractory can vary from zero to over 1000° F. This large differential in combination with the very different rates of expansion creates difficult problems in properly mounting the catalyst element. On the one hand it is necessary to avoid clearance that would permit the catalyst element to move and be cracked, chipped, or extruded. On the other hand, it is also necessary to avoid interference which could cause the catalyst element to be cracked or crushed thereby leading to clearance and associated damage.

In addition to troublesome thermal conditions, the conditions under which a motor vehicle is operated can cause mechanical damage to an improperly mounted monolithic refractory catalyst element. Constant or excessive vibration, shock loads, etc., occur regularly in driving and it is necessary to insulate the catalyst element from them.

Further, in manufacturing, storage, installation, and general handling, the converter is likely to be dropped or thrown around in such a way as to be subjected to severe shock loads that are capable of damaging the brittle refractory.

These problems must be solved by practical means that can be incorporated in a converter capable of mass production.

BRIEF SUMMARY OF THE INVENTION

With reference to the problems outlined above, it is the purpose of the invention to provide a catalytic converter with means for retaining a refractory catalyst element in a metal housing in such a way as to minimize the possibility of damage to the element due to thermal loads, operating loads, and rough handling.

In accomplishing this the invention provides at least one relatively flat spring pad (e.g. metal mesh or spring washers) that is positioned and arranged in the converter housing to continuously apply axial spring pressure to an end of the catalyst element. Since spring pads have minimum axial length, resilient axial retention is achieved in a housing of minimum length. The invention also reveals various ways to utilize different metal to provide a thermal compensation means in order to reduce thermal loads on the refractory.

Figure 1:
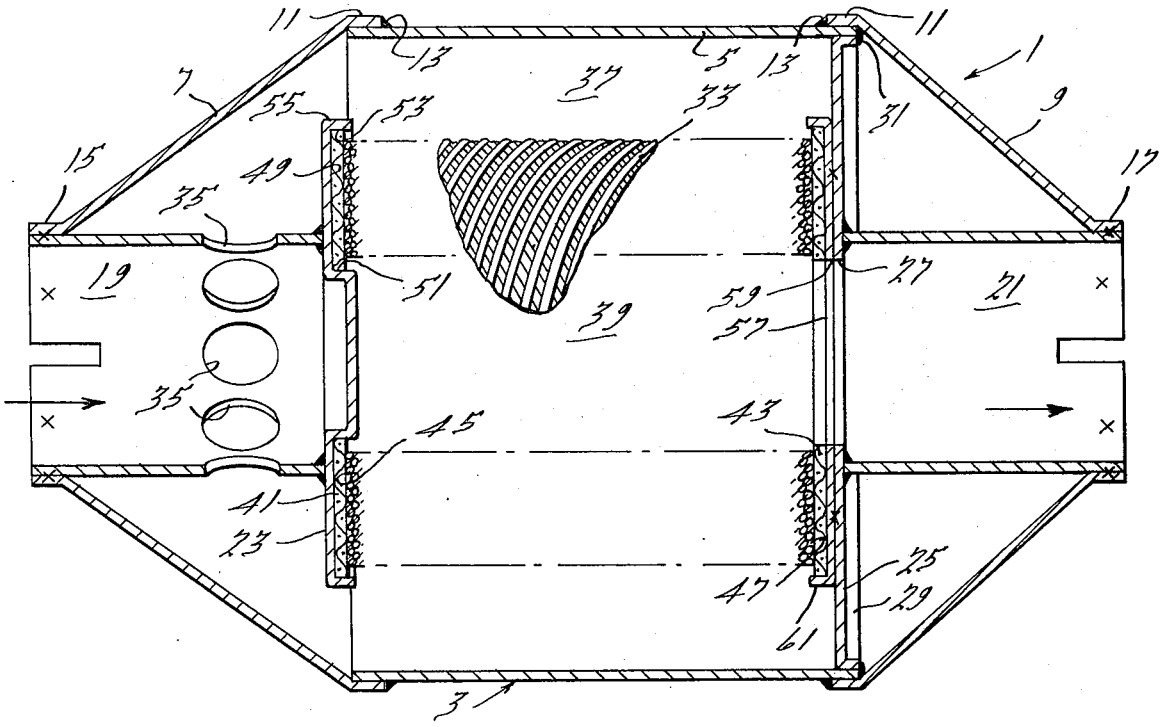
FIG. 1 is a longitudinal section along the axis of a catalytic converter containing a catalyst element mounted in accordance with the invention.

The symbol "*x*" used in the drawing indicates a spot-weld.

DESCRIPTION OF THE INVENTION

The catalytic converter 1 has a metal housing 3 that comprises a central tubular member or shell 5 of circular cross section and inlet and outlet end caps or cones 7 and 9 that have flanges 11 fitting around the outside of the shell and welded to it at 13. The small diameter ends of the cones are provided with necks 15 and 17 to which are spotwelded (as indicated by the *x's*) to short inlet and outlet tubes 19 and 21, respectively. The inner end of inlet tube 19 is welded to an imperforate transverse plate 23, which is supported by the tube so that loads on the plate are transmitted by the tube into the cone 7. The inner end of outlet tube 21 is welded to a transverse partition 25 so that it surrounds a central opening 27 in the partition. The partition has an annular circumferential flange 29, directed toward the outlet cone 9, which preferably is welded at its end edge only to the end of the shell 5 as seen at 31.

A tubular, radial flow type catalyst element 33 extends longitudinally between the plate 23 and partition 25 and is supported by them. The inlet tube 19 has a series of openings 35 in its wall for the passage of gas into an annular inlet chamber 37 that is defined by the outside of tube 19 and element 33 along with the inside of cone 7, shell 5, and partition 25.

In operation as a converter, gas enters the inlet tube 19 and flows through openings 35 into the inlet chamber 37. It then flows radially through the catalyst element 33 into an outlet chamber 39 that is defined by the inner periphery of the element. From there, it flows longitudinally through opening 27 into outlet tube 21 and out of the converter. The total area of openings 35, the size of opening 27, and the volume, dimensions, and porosity of catalyst element 33 are selected to give the desired residence time for gas in the catalyst and back pressure imposed on the exhaust system by the converter. The openings 35 may be louvers, elongated slots, or simple round holes (as shown) and can be used to provide a means to control peripheral gas flow distribution to the element 33. It is to be noted that if additional sound attenuation is desired openings may be put into the wall of tube 21 to connect its interior gas flow passage with the space surrounding the tube inside cone 9.

The illustrated catalyst element 33 comprises a tubular gas pervious substrate containing a huge number of small passages that permit gas to flow radially from chamber 37 to chamber 39. The flow path is illustrated as outside-in but it can be reversed (i.e., inside-out) if faster warm-up time is needed. Suitable catalyst material is deposited on the interior surfaces of the substrate and it promotes the conversion of undesired emissions in the exhaust gas flowing through the unit. For example, the catalyst material may be selected to promote the oxidation of unburned hydrocarbons and carbon monoxide. Suitable catalyst compositions are known in the art and are not a part of the invention.

The substrate is preferably formed from long continuous, flexible threads or strands composed of alumina ceramic fibers into a tubular form as illustrated. The ceramic thread is wound back and forth at an angle to the axis of the substrate (e.g. about 60°) to produce the desired size and the catalyst material is deposited on the surfaces of the ceramic fibers. Since the substrate is formed of fibers it has a very large ratio of interior surface area to volume and considerable control over the surface and flow characteristics and the actual contour of radial flow paths between the inner and outer peripheries is available by variations in the fiber winding process. The structure tends to create turbulence in the gas flowing through the substrate and give a more active catalyst surface than some other types of substrates that are proposed for use in motor vehicle exhaust converter systems. This this type of substrate has excellent stability at elevated temperatures and significant resilience and compressibility, both axial and radial, so that it has relatively good shock resistance for a body of refractory material. While the porosity or density and the actual dimensions of the element 33 will depend upon the intended application, for currently popular automobiles manufactured in the United States (e.g. about 300–500 C.I.D. engines) elements have a density of about 26 cubic inches per pound and having an inner diameter of about 2.0 inches and an outer diameter of about 3.5 inches and 4.5 inches in shells 5 of about 1 inch larger outer diameter have been tested. The inner diameter of the element is thus rather close to that of the exhaust system conduits which are normally about 1 ¾ to 2.0 inches. The length of the element can vary to give the desired volume, lengths of about 4¾ and 9½ inches having been used in tests.

In order to provide a shock insulation mounting and seal for the element 33, circular rings 41 and 43 of resilient wire mesh are compressed between its upstream and downstream ends 45 and 47 and the adjacent plate 23 and partition 25. In one application where the element 33 weighed about 2½ lbs. and was about 9½ inches long, A.I.S.I. 304 stainless steel wire of 0.007–0.011 inch diameter was woven into sock or sleeve form, rolled up into a doughnut or toroidal shape, and then compressed to a disk or ring having a free height of about ⅛ inch. The assembly shown in FIG. 1 was axially preloaded at room temperature to 1500 pounds which compressed the ⅛ inch thick gasket about 1/32 inch and also axially compressed the substrate by about 0.025 inch. In general, wire mesh requirements are dependent on the size and strength of the substrate, the sealing requirements, and the temperature environment. For extremely severe temperature conditions, mesh formed from very high hot strength materials, such as A-286 or Inconel 601 or X-750, may be used. The mesh metal preferably has a higher coefficient of thermal expansion than the metal of the shell 5. Wire mesh is available on the open market, being sold, for example, under the trademark "Metex" by Metex Corporation of Edison, New Jersey. In general it is preferred that the wire mesh be compressed to about ¼ – ½ of its free height at assembly under a preload that is preferably in the range of about 600 – 1500 pounds with elements as described above, i.e., woven substrates of substantially 3½ to 4¾ inches outer diameter, 1¾ to 2 inches inner diameter, and 4¾ to 9½ inches long. The amount of compression of the mesh at assembly is also preferably at least twice the amount of difference in expansion in length between the element and shell.

As a support for the metal mesh gasket 41, the metal plate 23 is formed as shown in FIG. 1 to have an annular gasket retaining trough 49 defined by an inner, axially extending annular wall 51 and an outer, axially extending annular wall 53 provided by the peripheral flange 55. The walls 51 and 53, i.e., the depth of annular trough 49, are preferably longer than the compressed, assembled thickness of ring 41. Thus, the flange 55 acts as a baffle that tends to prevent gas from impinging on the edge of the ring 41. This feature supplements the highly compressed condition of the mesh to enable it to act as a gas seal to inhibit flow of untreated exhaust gas past the substrate edges. The resilient, flexible nature of the mesh enables it to conform to and provide a good seal between the relatively rough substrate surface and the relatively smooth metal surface.

As a support for the mesh gasket 43 at the downstream end of the converter, a metal mounting plate 57 is spotwelded to metal partition 25. It has a central opening 59 aligned with opening 27 and an outer, axially extending flange 61 which, like flange 55, acts as a baffle to inhibit gas flow into the ring 43. The gasket 43 functions in a manner substantially identical to that of gasket 41.

The resilient mesh rings 41 and 43 act as the primary means to retain the element 33 in both the axial and radial directions. They also provide a resilient cushion to absorb mechanical shock and vibratory loads and differential thermal expansion of the various metal parts and the refractory substrate. As indicated, the mesh also serves as a gas seal to inhibit bypassing of the catalyst by untreated gas.

The shell 5 and cones 7 and 9 are preferably composed of A.I.S.I. 409 martensitic stainless steel which has a coefficient of thermal expansion of about $7.5 \times 10^{-6}$ in./in./° F (80°–1800° F). The inlet tube 19 is preferably composed of a higher expansion material such as A.I.S.I. 304 austenitic stainless steel having a coefficient of thermal expansion of about $11.2 \times 10^{-6}$ in./in./° F or A.I.S.I. 321 having a coefficient of about $11.5 \times 10^{-6}$ (80°–1800° F). The inlet tube 19 with plate 23 is fixed at one end only to the housing and will therefore tend to grow more with an increase in temperature than the shell 5 to at least partially offset or compensate for the much lower coefficient of thermal expansion of the substrate (which is in the neighborhood of $2–3 \times 10^{-6}$ in./in./° F) (80°–1900° F). This added growth provides a compensation means to aid in maintaining axial compression on the substrate during hot converter operation. The outlet 21 and the end welded (i.e., weld 31) partition 25 should preferably be formed of the same metal and it should have no less a rate of thermal expansion than the metal of shell 5. It may be metal having a greater coefficient (such as 304 and 321 A.I.S.I. stainless), in which case some additional compensation will be obtained. Very substantial additional compensation, comparable to that obtained with tube 19 and partition 23, may be obtained by omitting weld 31 so that partition 25 is movable longitudinally relative to shell 105 and forming tube 21 of high thermal expansion material as discussed above in connection with tube 19. The arrangement would then amount to a thermal compensation clamp with partitions 23 and 25 tending each to move toward the other by virtue of the higher thermal expansion rate of their respective support tubes 19 and 21.

Figure 2:
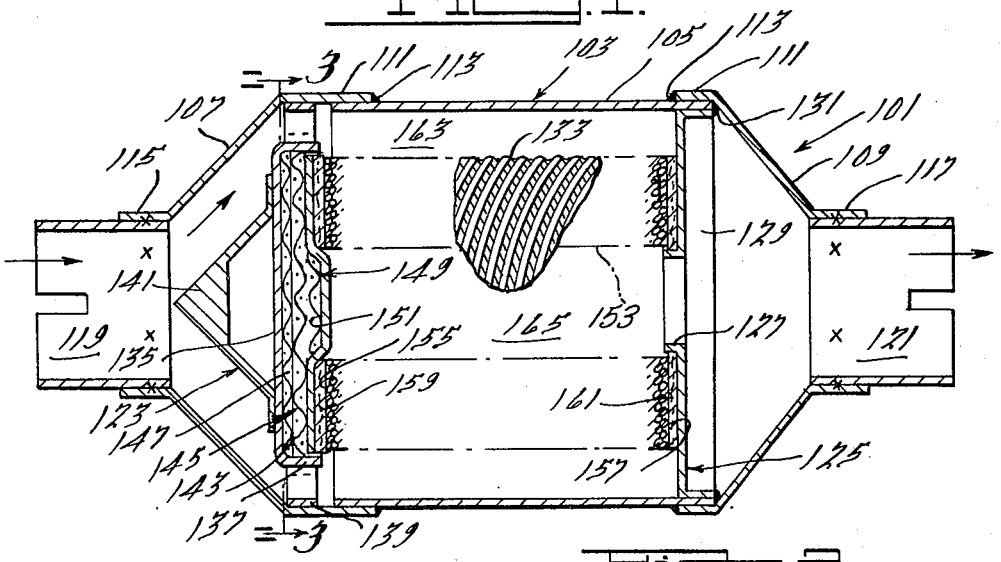
FIG. 2 is a longitudinal section similar to FIG. 1 of a different embodiment of the invention.
Figure 3:
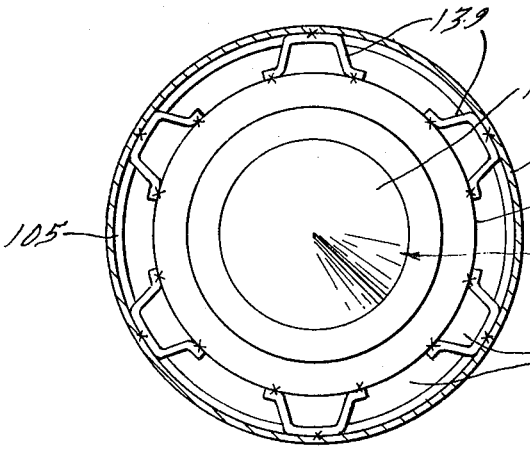
FIG. 3 is a cross section along the line 3—3 of FIG. 2.

The converter 101 of FIGS. 2 and 3 has a housing 103 with a central shell 105 and conical end caps 107 and 109. The cones have circumferential flanges 111 that fit around the ends of the shell 105 and are welded to it as seen at 113. The cones have necks 115 and 117, respectively, in which are spotwelded inlet and outlet bushings 119 and 121. A transverse partition means 123 is secured inside of flange 111 of inlet cone 107 and a transverse partition 125 is secured in the outlet end of shell 105. Partition 125 has a flanged central opening 127 extending axially upstream and a circumferential flange 129 extending axially downstream which is preferably welded at its downstream edge only to the shell as shown at 131. Extending between and mounted on the partition means 123 and partition 125 is a tubular catalyst element 133 which preferably is the same as element 33 described above. Partition 125 may be formed of metal having a greater rate of thermal expansion than the metal of shell 105, as explained above, to provide a thermal compensation means to partially offset the greater axial thermal growth of the shell as compared to the refractory 133. Since the partition is secured to the shell only at weld 131, its transverse wall can move longitudinally relative to the shell.

Figure 4:
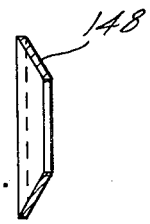
FIG. 4 is a detail cross section of a spring washer.

The partition means 123 includes an imperforate metal plate 135 which has an outer circumferential, axially extending flange 137. A series of hat-shaped tabs or arches 139 are spotwelded to the flange 137 and to the inside of cone flange 111 as shown in FIG. 3 to fix the plate 135 in position whereby it serves as a partition means extending transversely across the converter. A target type flow distributor 141, of conical (as shown) or other suitable shape, is secured to the front or upstream face of plate 135 to improve the gas flow pattern and provide some heat insulation for the plate. The flange 137 defines a chamber 143 within the plate 135 which contains a pad type (flat) spring means 145 such as the metal wire mesh 147 illustrated in FIG. 2 or other types of known relatively flat metal springs such as wave washers, Belleville washers (illustrated at 148 in FIG. 4), finger washers, etc., as disclosed in my copending U.S. application Ser. No. 567,578, filed of even date herewith. A helical coil spring is not a flat spring and consumes too much axial space to be practical. The wire mesh or spring means presses against an axially movable imperforate plate 149 that substantially closes the chamber 143 and has a dished central portion 151 that fits inside the inner periphery 153 of the catalyst element 133.

The opposite end faces 155 and 157 of the substrate 133 are supported on movable plate 149 and fixed partition 125 via intervening annular high temperature gas seal gaskets 159 and 161. These may, for example, be made of asbestos or ceramic fiber, or flattened wire mesh such as shown above at 43. The gaskets and substrate are centered on the central portion 151 and the neck 127 of plate 149 and partition 125.

The shock absorbent member 147 in one application was formed from knitted mesh strip of X-750S alloy that was cut into circular disks and about 12 were stacked as strata to form a mesh layer with a free height of about 1⅜ inches. This was compressed at assembly of the converter to ½ to ¾ inch as a result of a preload on the parts. The knitted wire mesh layer or pad served as a spring means to cushion the substrate 133 from shock loads, to restrain the substrate axially, and to compensate for different rates of thermal expansion between the housing and substrate.

In operation of the converter 101, exhaust gas enters the inlet bushing 119 and is directed outwardly by flow distributor 141 to pass through openings 162 between and through tab arches 139 and enter the annular inlet chamber 163 surrounding the catalyst element 133. It flows radially through the element, where conversion of undesired constituents is initiated, to enter the outlet chamber 165 and then pass out of the converter through the outlet bushing 121.

In both forms of converter flow can be reversed, so that it is inside-out, by using tube 17 or 117 as the inlet and tube 19 or 119 as the outlet.

Thus, the invention provides a flat spring pad means inside of a disposable or throwaway, mass production type catalytic converter for use in motor vehicle exhaust systems which, being short in length, minimizes the length of the converter and being preloaded and precompressed, and composed of a metal that has hot strength, applies a continuous, resilient axial force to the catalyst element to absorb shock and thermal loads on it.

Modifications may be made in the specific structures and materials disclosed without departing from the spirit and scope of the invention.

Thermal compensation means involving the use of two metals with different rates of thermal expansion is disclosed in copending U.S. application, Ser. No. 342,280, filed Mar. 16, 1973, of Robert N. Balluff and James D. Stormont which is assigned to the assignee hereof.

I claim:

1. A catalytic converter for combustion engine exhaust systems comprising an elongated metal shell having its opposite ends open, a pair of end caps fixedly secured respectively to said shell at opposite ends, one of said end caps having a port therein providing an inlet for gas to enter the shell and the other having a port therein providing an outlet for gas to leave the shell, a metal inlet gas flow tube secured at its outer end to said inlet end cap, a metal outlet gas flow tube secured at its outer end to said outlet end cap, a pair of transverse partitions secured respectively to the inner ends of the flow tubes, a catalyst element in said housing including an annular refractory gas pervious monolithic substrate having a relatively low rate of thermal expansion compared to that of said metal shell and extending between and mounted at opposite ends on said transverse partitions, said substrate being substantially smaller in diameter than said shell and having inlet and outlet faces that are substantially cylindrical in shape and radially disposed with respect to each other such that the exhaust gas flows radially through the substrate from the inlet to the outlet face, at least one of said gas flow tubes being composed of metal having a substantially greater rate of thermal expansion than the metal of said shell and the partition secured thereto being longitudinally movable with respect to said shell to provide a thermal compensating means to at least partially offset the difference in thermal expansion between the substrate and metal shell.

2. A converter as set forth in claim 1 wherein both of said gas flow tubes are composed of metal having a substantially greater rate of thermal expansion than the metal of the shell and both of said partitions are longitudinally movable with respect to the shell.

* * * * *